US011466612B2

(12) United States Patent
Schmidt et al.

(10) Patent No.: US 11,466,612 B2
(45) Date of Patent: Oct. 11, 2022

(54) INTEGRATED TURBOCHARGER OIL FEED

(71) Applicants: Michael P Schmidt, Highland, MI (US); John G McKinney, Oxford, MI (US); Nikhil Punneri Madathil, Rochester Hills, MI (US)

(72) Inventors: Michael P Schmidt, Highland, MI (US); John G McKinney, Oxford, MI (US); Nikhil Punneri Madathil, Rochester Hills, MI (US)

( * ) Notice: Subject to any disclaimer, the term of this patent is extended or adjusted under 35 U.S.C. 154(b) by 0 days.

(21) Appl. No.: 17/194,519

(22) Filed: Mar. 8, 2021

(65) Prior Publication Data

US 2021/0285367 A1 Sep. 16, 2021

Related U.S. Application Data

(60) Provisional application No. 62/988,563, filed on Mar. 12, 2020.

(51) Int. Cl.
*F02B 39/14* (2006.01)
*F01D 25/16* (2006.01)
(Continued)

(52) U.S. Cl.
CPC ..... *F02B 39/14* (2013.01); *F01D 25/16* (2013.01); *F02F 1/243* (2013.01); *F02F 11/002* (2013.01); *F05D 2220/40* (2013.01)

(58) Field of Classification Search
CPC ..... F02B 39/14; F01D 25/16; F01D 25/18; F01D 25/24; F02F 1/243; F02F 11/002;
(Continued)

(56) References Cited

U.S. PATENT DOCUMENTS 7,025,579 B2 4/2006 Woollenweber et al.
8,955,318 B2 2/2015 Marques et al.
(Continued)

FOREIGN PATENT DOCUMENTS

WO 20120087907 A2 6/2012
WO 20130142090 A1 9/2013

OTHER PUBLICATIONS

International Search Report and Written Opinion dated Jun. 24, 2021 for International Application No. PCT/US2021/021827, International Filing Date Mar. 11, 2021.

*Primary Examiner* — Audrey B. Walter
*Assistant Examiner* — Dapinder Singh
(74) *Attorney, Agent, or Firm* — Ralph E. Smith

(57) ABSTRACT

A cylinder head assembly for an internal combustion engine includes a cast cylinder head having at least one oil gallery, a turbocharger housing integrally cast with the cylinder head, and a turbocharger cartridge assembly configured to be inserted into the turbocharger housing and including at least one bearing rotatably supporting a shaft coupled between a compressor wheel and a turbine wheel. A lubricant passage is formed within the turbocharger housing and configured to supply oil from the at least one oil gallery to the turbocharger cartridge assembly to lubricate the at least one bearing. A seal assembly is disposed at least partially within the turbocharger housing to receive lubricant from the lubricant passage and includes a sealing end configured to seal against the turbocharger cartridge assembly.

15 Claims, 3 Drawing Sheets

(51) Int. Cl.
*F02F 11/00* (2006.01)
*F02F 1/24* (2006.01)

(58) Field of Classification Search
CPC ..... F05D 2220/40; F05D 2230/21; F01M 2011/021
See application file for complete search history.

(56) References Cited

U.S. PATENT DOCUMENTS

| | | | | |
|---|---|---|---|---|
| 9,903,251 | B1 * | 2/2018 | Belter | F01N 13/18 |
| 10,047,661 | B1 * | 8/2018 | Torgerud | B63H 20/28 |
| 2004/0160016 | A1 * | 8/2004 | Hatch | F16J 15/328 277/551 |
| 2013/0130577 | A1 * | 5/2013 | Ochiai | F01N 13/08 60/299 |
| 2013/0210295 | A1 * | 8/2013 | Davis | B63H 20/12 903/902 |
| 2013/0269339 | A1 * | 10/2013 | Marques | F02C 6/12 60/605.1 |
| 2013/0291540 | A1 * | 11/2013 | Serres | F01D 17/105 60/605.1 |
| 2017/0370278 | A1 | 12/2017 | McGahey et al. | |
| 2021/0010412 | A1 | 1/2021 | Schmidt et al. | |

* cited by examiner

INTEGRATED TURBOCHARGER OIL FEED

CROSS REFERENCE TO RELATED APPLICATION

This application claims the benefit of U.S. Provisional Pat. App. No. 62/988,563, filed on Mar. 12, 2020, the contents of which are incorporated herein by reference thereto.

FIELD

The present application relates generally to turbocharged internal combustion engines and, more particularly, to an oil feed system for a turbocharger integrated into a cylinder head.

BACKGROUND

Typical turbochargers include a compressor and a turbine coupled by a common shaft. An air intake supplies air to the compressor where it is compressed, mixed with fuel, and subsequently directed to the engine cylinders for combustion therein. Exhaust gases from the engine are directed to the turbine, utilized to drive the compressor, and subsequently directed to an exhaust system of the vehicle. Such conventional turbochargers are typically bolted-on to the cylinder head and include external tubing for supplying high pressure oil to the turbocharger bearing system. However, leakage at the joints of the external tubing can potentially occur over time. Thus, while such turbocharger systems do work well for their intended purpose, it is desirable to provide continuous improvement in the relevant art

SUMMARY

In accordance with one example aspect of the invention, a cylinder head assembly for an internal combustion engine is provided. In one example implementation, the cylinder head assembly includes a cast cylinder head having at least one oil gallery, a turbocharger housing integrally cast with the cylinder head, and a turbocharger cartridge assembly configured to be inserted into the turbocharger housing and including at least one bearing rotatably supporting a shaft coupled between a compressor wheel and a turbine wheel. A lubricant passage is formed within the turbocharger housing and configured to supply oil from the at least one oil gallery to the turbocharger cartridge assembly to lubricate the at least one bearing. A seal assembly is disposed at least partially within the turbocharger housing to receive lubricant from the lubricant passage and includes a sealing end configured to seal against the turbocharger cartridge assembly.

In addition to the foregoing, the described cylinder head assembly may include one or more of the following features: wherein the sealing end seals against a cylindrical outer surface of the turbocharger cartridge assembly; wherein the sealing end includes a conical seal configured to seal against the turbocharger cartridge assembly; wherein the conical seal is at least partially disposed within a bore formed in the sealing end; wherein the conical seal is rubber; wherein the seal assembly includes a body having the sealing end and an opposite end with a flange; and wherein the flange is coupled to an outer surface of the turbocharger housing.

In addition to the foregoing, the described cylinder head assembly may include one or more of the following features: wherein the seal assembly includes a body having a transverse oil passage fluidly coupled to a vertical oil passage; wherein the transverse oil passage receives oil from the lubricant passage, and the vertical oil passage supplies oil to a lubricant supply port formed in the turbocharger housing; wherein the seal assembly includes a body having a first portion with a first diameter greater than a second diameter of a second portion of the body.

In addition to the foregoing, the described cylinder head assembly may include one or more of the following features: an annular seal disposed about the body first portion; wherein the seal is disposed to facilitate preventing oil leakage between the lubricant passage and an outside of the turbocharger housing; wherein the seal is disposed to facilitate preventing oil leakage between the lubricant passage and a lubricant cartridge bore formed in the turbocharger housing to receive the turbocharger cartridge assembly; wherein the seal assembly includes a body having a transverse oil passage formed therein configured to fluidly couple to the lubricant passage; and wherein the seal assembly further comprises a first annular seal disposed on a first side of the transverse oil passage, and a second annular seal disposed on an opposite second side of the transverse oil passage.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Described herein are systems and methods for feeding lubricant from a cylinder head to an integrated turbocharger bearing housing using a seal assembly. High pressure oil from the main oil gallery is transferred to the top of the bearing housing through drilled or casted passages in the cylinder head. A seal assembly is utilized to prevent oil leakage around the cartridge bore, and includes a body with both transverse and longitudinal internal oil passages, and external radial O-rings and a conical rubber seal. As oil is supplied through the seal assembly, the radial O-rings seal oil from leaking to the environment and the center housing bore. The rubber seal is positioned toward a tip of the seal assembly and is biased onto the external surface of the cylindrical bearing housing to facilitate proper sealing of the high pressure oil.

Unlike other face or axial seals, the conical type seal facilitates sealing between cylindrical surfaces and is designed with an inner diameter larger than the oil feed bore in the center housing to ensure sealing even in the event of minor angular misalignment. The sealing assembly facilitates reduction in machining on the bearing housing, and is easily coupled to the cylinder head to ensure the position of the seal assembly relative to the bearing housing.

Figure 1:
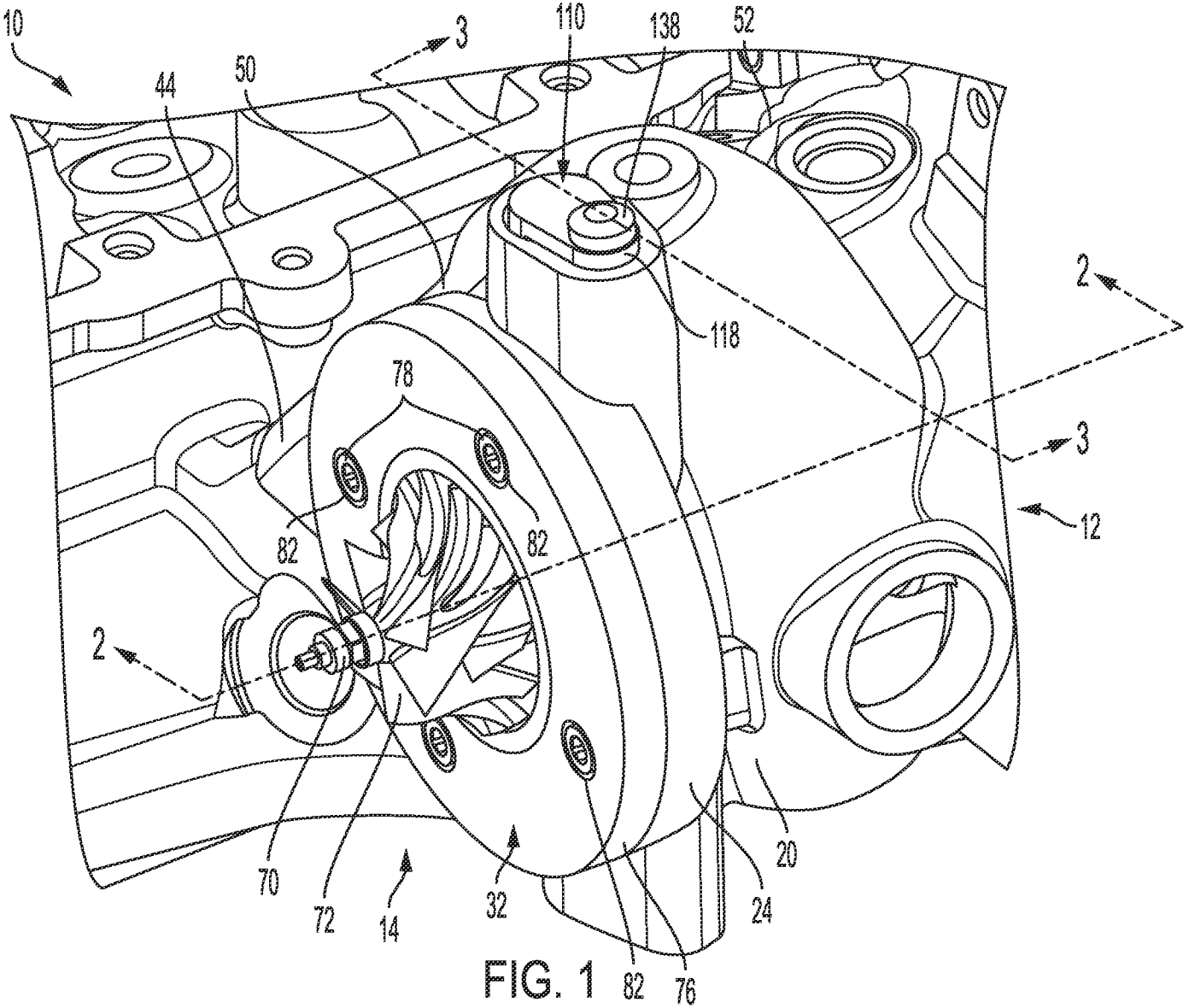
FIG. 1 is a perspective view of an example cylinder head casting with an integrally cast turbocharger housing in accordance with the principles of the present application.
Figure 2:
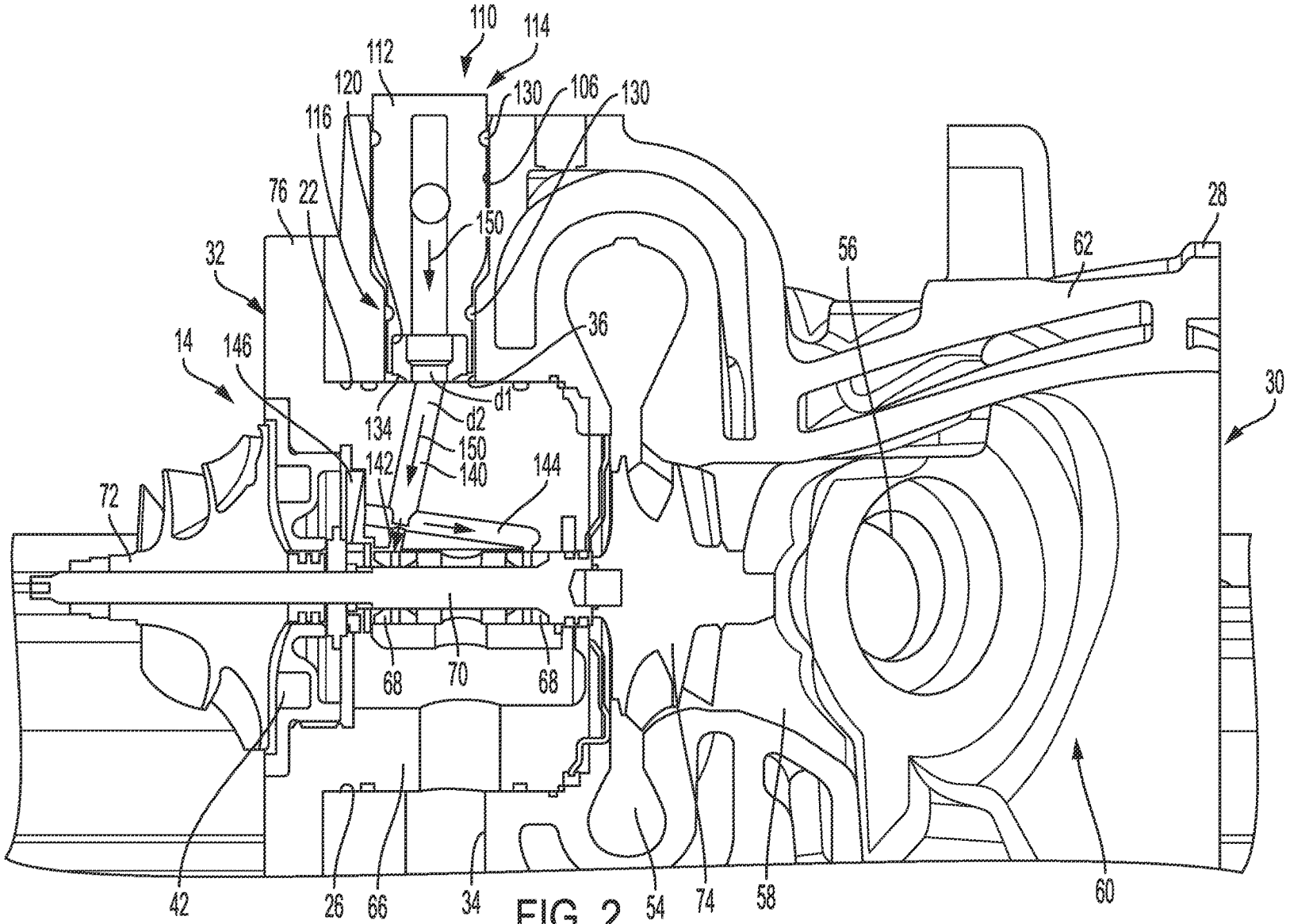
FIG. 2 is a cross-sectional view of the cylinder head and integrated turbocharger shown in FIG. 1 and taken along line 2-2, in accordance with the principles of the present application.

With reference to FIGS. 1 and 2, an example cylinder head for an internal combustion engine is shown and indicated at reference numeral 10. In the example embodiment, the cylinder head 10 includes an integrated (cast-in) turbocharger housing 12 that makes up part of a turbocharger assembly 14. The turbocharger housing 12 is integrated (e.g., cast) into an aluminum cylinder head 10, to thereby advantageously reduce engine cost, improve packaging, simplify assembly, reduce number of assembly steps, improve catalyst light off emissions, reduce turbocharger noise (e.g., wastegate resonances, flow noise, rotor group unbalance whine, etc.), improve engine warm up, and improve fuel economy. The system may additionally include one or more features described in commonly owned and co-pending U.S. patent application Ser. No. 16/924,450, filed on Jul. 9, 2020, the contents of which are incorporated herein in their entirety by reference thereto.

With continued reference to FIGS. 1 and 2, the turbocharger housing 12 is cast with the cylinder head 10 and generally includes a main housing 20 defining a cartridge bore 22, an inlet flange 24 defining a cartridge opening 26, and an outlet flange 28 defining an exhaust outlet 30. The cartridge bore 22 is configured to receive a turbocharger cartridge assembly 32, which is configured to align with and fluidly connect to a drain hole 34 and a lubricant supply port 36 formed in the turbocharger housing 12. The drain hole 34 is configured to drain a lubricant (e.g., oil) supplied to the cartridge assembly 32 via the lubricant supply port 36, as described herein in more detail.

In the example embodiment, the cartridge opening 26 is configured to receive cartridge assembly 32 therein, followed by a compressor housing that defines a compressor inlet (not shown), which is fluidly coupled to a compressor outlet 42 of a compressor outlet duct 44 configured to provide compressed intake air to an intake manifold of the engine (not shown). Although described as a separate component, one or more portions of the compressor housing may be integrally cast with the turbocharger housing 12.

In the example embodiment, the turbocharger housing 12 includes an integrated (cast-in) turbine inlet duct 50 and wastegate inlet duct 52 (FIG. 1), which are respectively coupled to a turbine inlet 54 and a wastegate inlet 56 (FIG. 2). Although not shown, the turbine inlet 54 is configured to receive exhaust gas from an exhaust manifold of the engine, and direct the exhaust gas through a turbine outlet 58 formed in the turbocharger housing 12. The turbine outlet 58 is then configured to supply exhaust from the turbine of the cartridge assembly 32 to a wastegate chamber 60 defined by a wastegate housing 62 of the turbocharger housing 12. The exhaust from the wastegate chamber 60 is then supplied via exhaust outlet 30 to an exhaust system of the vehicle (not shown).

As shown in FIG. 2, in the example embodiment, the cartridge assembly 32 generally includes a cartridge housing 66 having one or more bearings 68 rotatably supporting a shaft 70 that rotatably couples a compressor wheel 72 to a turbine wheel 74. The compressor end of the cartridge housing 66 includes a flange 76 having a plurality of circumferentially located apertures 78 configured to align with corresponding apertures 80 (FIG. 3) formed through the turbo housing inlet flange 24. A plurality of fasteners 82 (FIG. 1) are inserted through apertures 78, 80 to thereby couple cartridge assembly 32 to the turbocharger housing 12. Once coupled, the turbine wheel 74 is disposed at least partially within the turbine outlet 58.

As described herein in more detail, the present disclosure provides systems and methods for supplying oil from the cylinder head 10 to the bearings 68 with internal passages rather than external tubes. With additional reference to FIG. 3, in the example embodiment, turbocharger housing 12 includes a lubricant passage 84, which fluidly couples the lubricant supply port 36 (FIG. 2) to an oil gallery 86 (FIG. 3) of the cylinder head 10. In this way, turbocharger housing 12 provides a system 100 for supplying lubricant (e.g., oil) to the cartridge assembly 32 without any external tubes or hoses.

With reference to now FIGS. 2 and 3, lubricant supply system 100 will be described in more detail. In the example embodiment, lubricant supply system 100 is configured to supply oil from the cylinder head oil gallery 86 to the cartridge assembly 32 for lubricating the one or more bearings 68 thereof. In the example embodiment, lubricant passage 84 is formed in the turbocharger housing 12 (e.g., via a cross drill) and includes a first end 102 fluidly coupled to the oil gallery 86, and a second end 104 fluidly coupled to a bore 106 formed in the turbocharger housing 12. As illustrated in FIG. 2, the bore 106 includes an open end 108 configured to receive a seal assembly 110, and an opposite end defining the lubricant supply port 36. In this way, the lubricant passage 84 is configured to supply high pressure oil to the cartridge assembly 32 via bore 106, which is sized and shaped to receive the seal assembly 110.

In the example embodiment, the seal assembly 110 is configured to seal the connection between the lubricant passage 84 and the supply port 36 and generally includes a body 112 having a first end 114 and an opposite second end 116. As shown in FIG. 3, the body first end 114 is defined with a larger diameter or cross-section than the body second end 116. As shown in FIGS. 1 and 3, the body first end 114 is formed with a flange 118 extending therefrom, and the body second end 116 is formed with an internal bore 120. Additionally, the body includes a transverse oil passage 122 and vertical oil passage 124 formed therein and configured to direct the lubricant supplied thereto from the lubricant passage 84.

Figure 3:
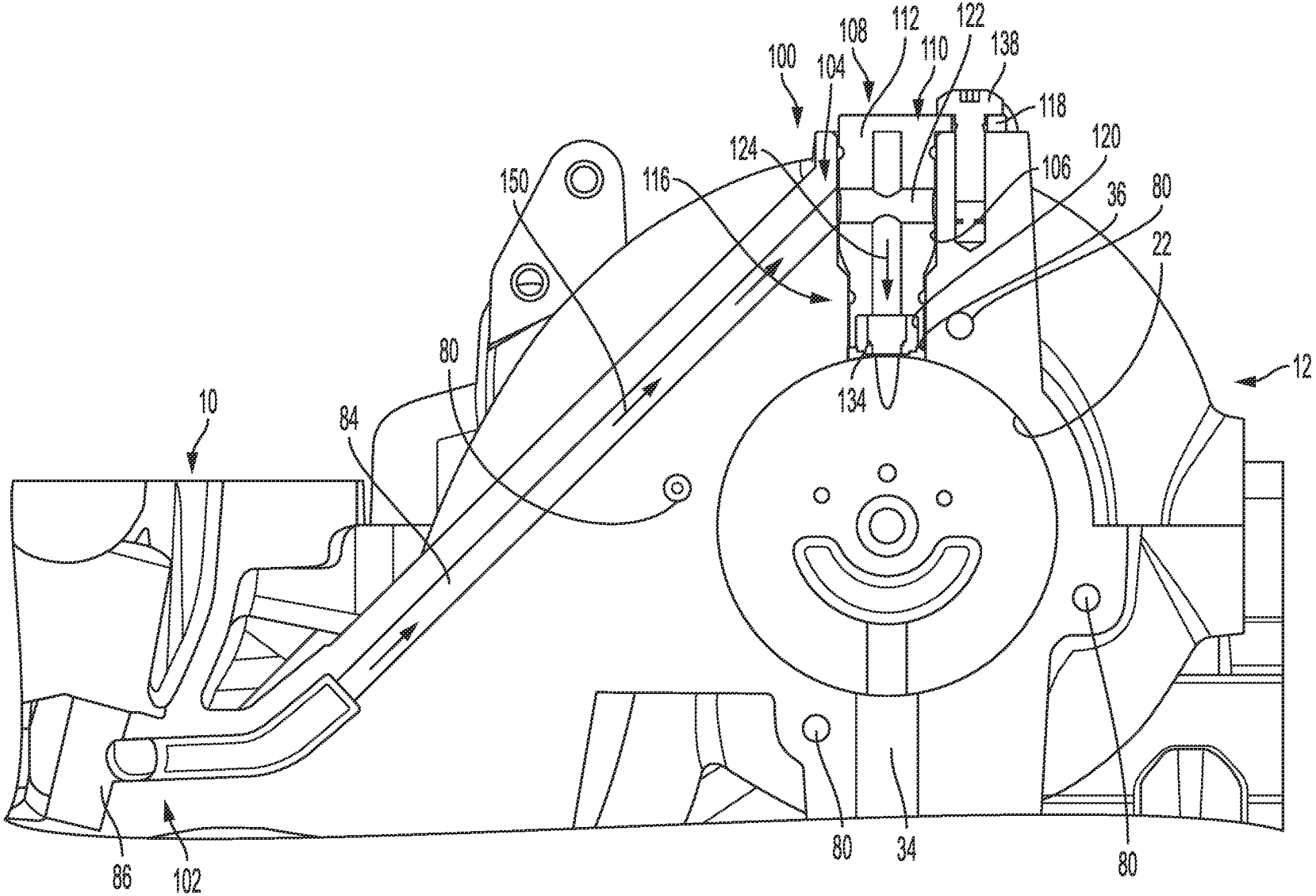
FIG. 3 is a cross-sectional view of the cylinder head and integrated turbocharger shown in FIG. 1 and taken along line 3-3, in accordance with the principles of the present application.

As shown in FIGS. 2 and 3, the seal assembly 110 includes a plurality of seals to seal the lubricant passage 84 from the environment. More specifically, the seal assembly 110 includes one or more annular seals 130 (e.g., O-rings) configured to provide sealing between the body 112 and the inner wall 132 that defines bore 106. Further, the second end internal bore 120 receives a conical rubber seal 134, which, when seal assembly 110 is installed into bore 106, is configured to be positioned onto cylindrical cartridge housing 66 to facilitate proper sealing of the high pressure oil.

Unlike other face or axial seals, which seal in a two-dimensional plane, the conical rubber seal 134 facilitates sealing with the cylindrical outer surface of the cartridge housing 66. Moreover, in the example embodiment, the conical type rubber seal 134 is configured such that an inner diameter 'd1' in the seal is larger than a diameter 'd2' of the oil feed bored in the cartridge housing 66 to facilitate sealing even if angular misalignments of the housing occur.

As shown in FIGS. 1 and 3, the seal assembly flange 118 includes an aperture 136 configured to receive a fastener 138 (e.g., bolt) to facilitate securing the seal assembly 110 to the turbocharger housing 12. In this way, the seal assembly 110 is securely coupled to the turbocharger housing 12 and prevented from rotation within bore 106, thereby maintaining proper fluid transferring orientation between lubricant passage 84 and the transverse oil passage 122, as well as between the vertical oil passage 124/rubber seal 134 and the supply port 36.

With continued reference to FIG. 2, in the example embodiment, oil is supplied through the cartridge housing 66 to the bearings 68 via a first bore or cross drill 140, a second bore or cross drill 142, and a third bore or cross drill 144. The first cross drill 140 is an inlet port fluidly coupled to the second cross drill 142 to provide lubricant to one bearing 68, while the third cross drill 144 includes a seal 146 at one end and is fluidly coupled to the first cross drill 140 to provide lubricant to the other bearing 68.

In operation, as shown in FIGS. 2 and 3 by the arrows representing a high pressure oil feed path 150, oil is supplied through integrated lubricant passage 84 to the seal assembly 110, which seals leakage to the environment through bore open end 108 via upper seal 130. Similarly, seal assembly 110 seals leakage to the cartridge bore 22 through supply port 36 via lower seal 130. Lubricant passes through transverse passage 122, vertical passage 124, and conical rubber seal 134 to the lubricant supply port 36.

The lubricant is subsequently directed into the first cross drill 140, the second cross drill 142, and the third cross drill 144. In the example embodiment, because the cartridge assembly 32 includes two bearings 68, a first portion of the oil feed path 150 is supplied via the second cross drill 142 to one bearing 68, while a second portion of the oil feed path 150 is supplied via the third cross drill 144 to the other bearing 68. Accordingly, in the example embodiment, the integrally cast turbocharger housing 12 includes lubricant supply system 100 to supply oil from the cylinder head 10 to the turbocharger bearings 68 without any external tubing.

Described herein are systems and methods for internally supplying lubricating oil to the bearings of a turbocharger cartridge assembly. By integrally casting a turbocharger housing with the cylinder head, lubricating oil from the cylinder head oil gallery can be supplied to the turbocharger cartridge without external oil feed tubes, thereby simplifying the system, reducing packaging space, reducing costs, reducing/simplifying serviceability. Additionally, this concept requires less machining for the bearing housing compared to external oil feed concepts, further reducing the cost. Accordingly, a cost-effective sealing arrangement is provided with an easily installed seal assembly to establish a fluid seal between the cartridge assembly and the turbocharger housing to prevent oil leaks.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A cylinder head assembly for an internal combustion engine, the assembly comprising:

a cast cylinder head having at least one oil gallery;

a turbocharger housing integrally cast with the cylinder head;

a turbocharger cartridge assembly configured to be inserted into the turbocharger housing and including at least one bearing rotatably supporting a shaft coupled between a compressor wheel and a turbine wheel;

a lubricant passage formed within the turbocharger housing and configured to supply oil from the at least one oil gallery to the turbocharger cartridge assembly to lubricate the at least one bearing; and a seal assembly disposed at least partially within the turbocharger housing and having (i) a body defining an internal passage to receive lubricant from the lubricant passage, and (ii) a seal disposed at a tip of the body, the seal engaging a cylindrical outer surface of the turbocharger cartridge assembly to seal against the turbocharger cartridge assembly.

2. The cylinder head assembly of claim 1, wherein the seal is a conical seal configured to seal against the cylindrical outer surface of the turbocharger cartridge assembly.

3. The cylinder head assembly of claim 2, wherein the conical seal includes an inner diameter larger than a diameter of an oil feed bore formed in the turbocharger cartridge assembly to facilitate sealing even if angular misalignments of the turbocharger housing occur.

4. The cylinder head assembly of claim 2, wherein the conical seal is at least partially disposed within a bore formed in the sealing end.

5. The cylinder head assembly of claim 2, wherein the conical seal is rubber.

6. The cylinder head assembly of claim 1, wherein the body includes a sealing end and an opposite end with a flange.

7. The cylinder head assembly of claim 6, wherein the flange is coupled to an outer surface of the turbocharger housing, wherein the sealing end has a cylindrical seal extending outwardly therefrom to engage and seal against the cylindrical outer surface of the turbocharger cartridge assembly, and wherein the cylindrical outer surface of the turbocharger cartridge assembly is the outermost surface of the turbocharger cartridge assembly.

8. The cylinder head assembly of claim 1, wherein the internal passage comprises a transverse oil passage fluidly coupled to a vertical oil passage.

9. The cylinder head assembly of claim 8, wherein the transverse oil passage receives oil from the lubricant passage, and the vertical oil passage supplies oil to a lubricant supply port formed in the turbocharger housing.

10. The cylinder head assembly of claim 1, wherein the body includes a first portion with a first diameter greater than a second diameter of a second portion of the body.

11. The cylinder head assembly of claim 10, further comprising an annular seal disposed about the body first portion.

12. The cylinder head assembly of claim 11, wherein the annular seal is disposed to facilitate preventing oil leakage between the lubricant passage and an outside of the turbocharger housing.

13. The cylinder head assembly of claim 11, wherein the annular seal is disposed to facilitate preventing oil leakage between the lubricant passage and a lubricant cartridge bore formed in the turbocharger housing to receive the turbocharger cartridge assembly.

14. The cylinder head assembly of claim 1, wherein the internal passage includes a transverse oil passage formed therein configured to fluidly couple to the lubricant passage.

15. The cylinder head assembly of claim 14, wherein the seal assembly further comprises a first annular seal disposed on a first side of the transverse oil passage, and a second annular seal disposed on an opposite second side of the transverse oil passage.

* * * * *